United States Patent [19]

Ondracek

[11] Patent Number: 4,741,852

[45] Date of Patent: May 3, 1988

[54] NON-SLIP SOAP BAR CONSTRUCTION

[76] Inventor: John Ondracek, 234 Logan, Apt. 103, Denver, Colo. 80203

[21] Appl. No.: 7,221

[22] Filed: Jan. 27, 1987

[51] Int. Cl.[4] ..... C11D 17/04

[52] U.S. Cl. ..... 252/92; 252/90; 252/134; 252/174; 252/DIG.16; 15/222; 248/359 G; 248/359 J; 401/6; 401/48

[58] Field of Search ..... 252/90, 134, 174, DIG. 16, 252/132, 92; 15/222; 401/6, 48; 248/359 G, 359 J

[56] References Cited

U.S. PATENT DOCUMENTS

| | | | |
|---|---|---|---|
| 1,416,962 | 5/1922 | Meeks | 252/92 |
| 1,636,709 | 7/1927 | Schmidt | 248/359 G |
| 2,243,634 | 5/1941 | Kadish | 248/359 G |
| 3,196,112 | 7/1965 | Presley | 252/92 |
| 3,341,457 | 9/1967 | Schmidt | 252/174 |
| 3,519,568 | 7/1970 | Needleman | 252/134 |
| 3,860,349 | 1/1975 | Scott | 15/222 |
| 3,931,035 | 1/1976 | Brown | 252/134 |
| 4,062,792 | 12/1977 | McNabb | 252/DIG. 16 |
| 4,240,760 | 12/1980 | Levine | 401/201 |
| 4,613,446 | 9/1986 | Magyar | 252/91 |

FOREIGN PATENT DOCUMENTS

| | | | |
|---|---|---|---|
| 847650 | 6/1952 | Fed. Rep. of Germany | 252/92 |

*Primary Examiner*—Dennis Albrecht
*Assistant Examiner*—Hoa Van Le
*Attorney, Agent, or Firm*—Henderson & Sturm

[57] ABSTRACT

A non-slip soap bar construction (10) comprising: a bar of soap (13) having an upper half (14) and a lower half (15); and, an elongated generally I-shaped fabric member (16) captured between the upper and lower halves of the bar of soap (13); wherein, the enlarged ends (17) of the fabric member (16) project beyond the sides of the bar of soap (13) and form non-slip flap portions (18) that provide positive gripping surfaces for the bar of soap.

4 Claims, 1 Drawing Sheet

FIG. 1.
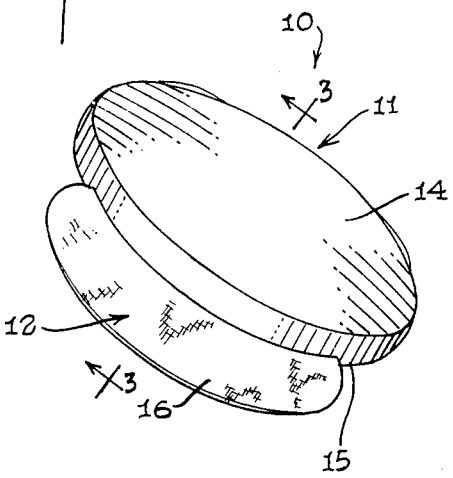
FIG. 2.
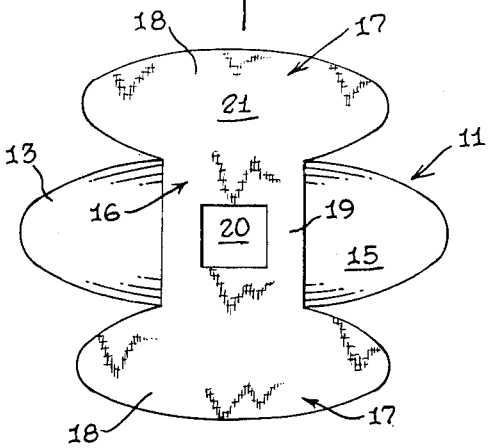
FIG. 3.
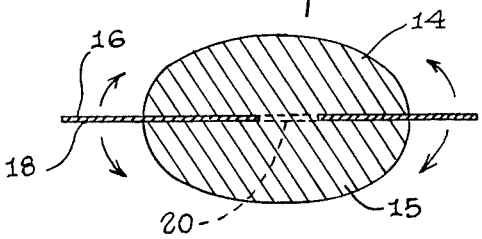
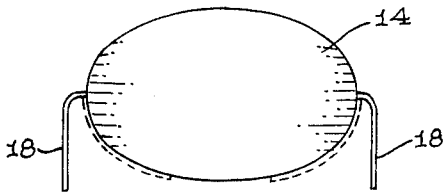
FIG. 4.

NON-SLIP SOAP BAR CONSTRUCTION

TECHNICAL FIELD

The present invention relates generally to soap bar constructions, and more specifically to specialized constructions to lend non-slip characteristics to a soap box.

BACKGROUND OF THE INVENTION

The non-slip soap bar construction of this invention was the subject matter of Document Disclosure Program Registration No. 156267 which was filed in the U.S. Patent and Trademark Office on Sept. 19, 1986.

The prior art is replete with diverse specialized soap bar constructions as may be seen by reference to U.S. Pat. Nos.: 4,240,760; 4,613,446; 3,931,035; and, 3,196,112. In addition to the aforementioned constructions, most people are also aware of the well recognized "soap on a rope" construction, which would also fall into the category of acknowledged prior art.

While most of the above listed prior art constructions contain structural components whose inherent function would provide a non-slip characteristic to the finished soap bar; only the Presley reference U.S. Pat. No. 3,196,112 was specifically designed, and developed to provide non-slip features to the finished soap bar.

In this prior art reference, a friction gripping tread in the form of an elongated strand of material is threaded through a bar or cake of soap; wherein, a plurality of loops of the friction gripping tread are exposed and disposed on the periphery of the bar of soap. The exposed portions of the thread provide anchored friction surfaces to facilitate the users grasp of the slippery soap bar; and, the useful life of this particular construction will last until such time as the anchoring penetrations of the elongated strand of material continue to exist.

While this particular prior art reference is adequate for its intended purpose and function; it also incorporates some inherent deficiencies into its basic design. The most significant of the noted deficiencies being the fact that; it is virtually impossible for a bather to employ the soap bar in the usual fashion, without the non-slip treads making initial and continual contact with the bathers skin during the bathing process.

Obviously there has been a long felt need for a non-slip soap bar construction; wherein, the non-slip structural component may be readily grasped by the bathers hand, without the necessity of the non-slip structural component coming into contact with the other portions of the bathers body during the bathing process.

SUMMARY OF THE INVENTION

The subject matter of the present invention represents a new and unique approach to satisfying the foregoing stated need.

Briefly stated, the non-slip soap bar construction of this invention comprises a soap bar unit containing a non-slip fabric unit that is formed integrally with the soap bar unit.

The non-slip fabric unit is incorporated into the soap bar unit in such a fashion that the fabric unit extends across the internal center of the soap bar unit. In addition, the fabric unit is dimensioned and configured such that the fabric unit projects beyond the sides of the soap bar unit in the form of flap members; and, the upper and lower halves of the soap bar unit are formed integrally in the middle and on the ends.

The flap members formed by the fabric unit provide a non-slip component that may be grasped by the user, such that either the upper or the lower half of the soap bar unit may be brought into direct contact with the bathers skin. In addition, at that point where the normal operative connection between the soap bar unit and the fabric unit would be lost due to the diminished size of the soap bar unit, the fabric unit may be converted into a receptacle for the remaining portion of the soap bar unit.

BRIEF DESCRIPTION OF THE DRAWINGS

These and other objects, advantages, and novel features of the invention will become apparent from the detailed description of the best mode of carrying out the preferred embodiment of the invention which follows; particularly when considered in conjunction with the accompanying drawings, wherein:

FIG. 1 is a perspective view of the non-slip soap bar construction of this invention;

FIG. 2 is a cross-sectional view taken through line 2—2 of FIG. 1;

FIG. 3 is a cross-sectional view taken through line 3—3 of FIG. 1; and, FIG. 4 is an end view of the non-slip soap bar construction.

BEST MODE FOR CARRYING OUT THE INVENTION

As can be seen by reference to the drawings, and in particular to FIG. 1, the non-slip soap bar construction of the present invention is designated generally by the reference numeral (10). The non-slip soap bar construction (10) comprises in general a soap bar unit (11) and a fabric unit (12). These units will now be described in seriatim fashion.

As shown in FIGS. 1 and 4, the soap bar unit (11) comprises a conventional bar or cake of soap (13) of generally rectangular or oval configuration and having an upper half designated as (14) and a lower half designated as (15).

As can best be seen by reference to FIGS. 2 and 3, the fabric unit (12) comprises an elongated generally I-shaped fabric member (16) interposed between the upper (14) and lower (15) halves of the soap bar unit (11); wherein, the fabric member (16) extends across the mid-point of the bar of soap (13).

As shown in FIG. 2, the enlarged ends (17) of the generally I-shaped fabric member (16) form flap portions (18) which project beyond the sides of the soap bar unit (11); and, whose purpose and function will be revealed presently. In addition, the reduced width intermediate stem portion (19) of the fabric member (16) is provided with an enlarged central aperture (20); and, the stem portion (19) extends across the internal width of the soap bar unit (11).

In the preferred embodiment of the invention illustrated in FIGS. 1 thru 4, the fabric member, (16) is fabricated from at least one layer of open pore fabric material (21) such as cheesecloth or the like, that has been suitably contoured to provide the generally I-shaped configuration of the fabric member (16).

As mentioned earlier on in the specification, the fabric member (16) is interposed between the upper (14) and lower (15) halves of the bar of soap (13); wherein, the ends of the bar of soap (13) are joined integrally. In addition the enlarged central aperture (20) in the fabric member (16) allows the center of the upper (14) and lower (15) halves of soap to be joined integrally.

The foregoing arrangement essentially captures the fabric member (16) between the upper (14) and lower (15) halves of the bar of soap (13); until such time as the bar of soap (13) has diminished in size, such that the remaining sliver of soap may pass through the central aperture (20) in the fabric member (16).

As long as there is an operative connection between the bar of soap (13) and the fabric member (16); the flap portions (18) of the fabric member (16) provide non-slip friction surfaces that the user may grasp to maintain a firm grip on the bar of soap (13). The flap portions (18) may optionally be disposed on either the upper (14) or lower (15) halves of the bar of soap (13) to insure that the bar of soap experiences uniform wear.

It should also be appreciated at this juncture (without the benefit of drawings) that once the bar of soap (13) has been reduced sufficiently in size, one or more of the flap portions (18) of the fabric member (16) can be wrapped around the remaining soap sliver in an enveloping relationship. Furthermore, when there is no longer an operative connection between the fabric member (16) and the sliver of soap, the fabric member (16) may be manipulated to form a fabric receptacle for the remaining sliver of soap.

Having thereby described the subject matter of this invention, it should be apparent that many substitutions, modifications, and variations of the invention are possible in light of the above teachings. It is therfore to be understood that the invention as taught and described herein, is only to be limited to the extent of the breadth and scope of the appended claims.

I claim:

1. A non-slip soap bar construction comprising:

a soap bar unit comprising a bar of soap having an upper half and a lower half; and, a fabric unit disposed intermediate the upper half and lower half of said bar of soap; wherein, the fabric unit comprises an elongated generally flat I-shaped flexible fabric member having enlarged ends and an intermediate portion; wherein, the intermediate portion of the fabric member extends across and is captured between the upper and lower halves of the bar of soap and the enlarged ends of the I-shaped flexible fabric member project beyond the sides of the bar of soap to form non-slip flap portions; whereby the enlarged ends of the I-shaped flexible fabric member form frictional gripping surfaces for a users hand and fingers; and, wherein the said flexible fabric member may engage the bar of soap in an enveloping relationship when the dimensions of the bar of soap have diminished.

2. The soap bar construction of claim 1; wherein, the intermediate portion of the fabric member is provided with an enlarged central aperture; whereby, the upper and lower halves of the bar of soap are joined integrally through said central aperture.

3. The soap bar construction of claim 2; wherein, the ends of the upper and lower halves of the bar of soap are joined integrally on both sides of the I-shaped fabric member.

4. The soap bar construction of claim 1; wherein, the fabric member is fabricated from at least one layer of open pore fabric material.

* * * * *